United States Patent [19]

Rifkin

[11] Patent Number: 4,661,990

[45] Date of Patent: Apr. 28, 1987

[54] HOODED TYPE BAG SEAL

[76] Inventor: Arnold S. Rifkin, 1400 Sans Souci Pkwy., P.O. Box 878, Wilkes-Barre, Pa. 18703-0878

[21] Appl. No.: 823,758

[22] Filed: Jan. 29, 1986

[51] Int. Cl.[4] ..... B65D 33/16

[52] U.S. Cl. ..... 383/97; 383/5; 383/78; 190/120

[58] Field of Search ..... 383/97, 78, 5; 190/903, 190/120; 150/101

[56] References Cited

U.S. PATENT DOCUMENTS

| | | | |
|---|---|---|---|
| 1,819,449 | 8/1931 | Walrath | 383/97 |
| 2,128,689 | 8/1938 | Bingham | 383/97 |
| 2,310,627 | 2/1943 | Greene | 383/97 |
| 4,112,990 | 9/1978 | Anderson | 383/97 |
| 4,494,592 | 1/1985 | Bonner | 383/97 |

*Primary Examiner*—Stephen P. Garbe

*Attorney, Agent, or Firm*—Robert K. Youtie

[57] ABSTRACT

A bag having side edges meeting at a corner, a slide fastener along one side edge, a hood conformably covering the bag corner and mounted to the bag for movement into and out of its corner covering relation, the hood having an opening for exteriorly passing the slider pull of the fastener when the latter is closed, and a tab extending externally from the hood for registry with the slider pull to receive a sealing shackle in the closed fastener condition.

7 Claims, 4 Drawing Figures

HOODED TYPE BAG SEAL

BACKGROUND OF THE INVENTION

While there have, in the past, been provided hood type seals for zipper bags wherein the slider pull is shackled to the hood, these prior art devices have not been sufficiently secure in many instances. For example, it has heretofore been possible to forcibly move the zipper runners relative to the shackled zipper slider and hood, to open or disconnect the zipper runners for a part of their length and thereby afford access between the opened regions of runners. This was sometimes possible without damaging the bag, so that tampering could go undetected.

Prior hood type zipper seals were more expensive to manufacture requiring high strength components, as of metal, and involved more steps and expense in assembly to a bag, or the like.

SUMMARY OF THE INVENTION

It is among the important objects of the present invention to provide a new hood type seal for slide fasteners which is of greatly enhanced tamper resistance by eliminating the possibility of displacing the new zipper runners through the hood and relative to the secured slider to separate and open the runners.

It is among the further objects of the present invention to provide a hood type zipper seal having the advantageous characteristics mentioned in the preceding paragraph, which may be less expensively manufactured, as by molding of plastic; more economically assembled to a bag as requiring only a single punched hole and one riveting operation rather than plural holes and grommets; and which is capable of quicker and easier sealing and unsealing by an operator for savings in time and more assurance that the seal will be properly used.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
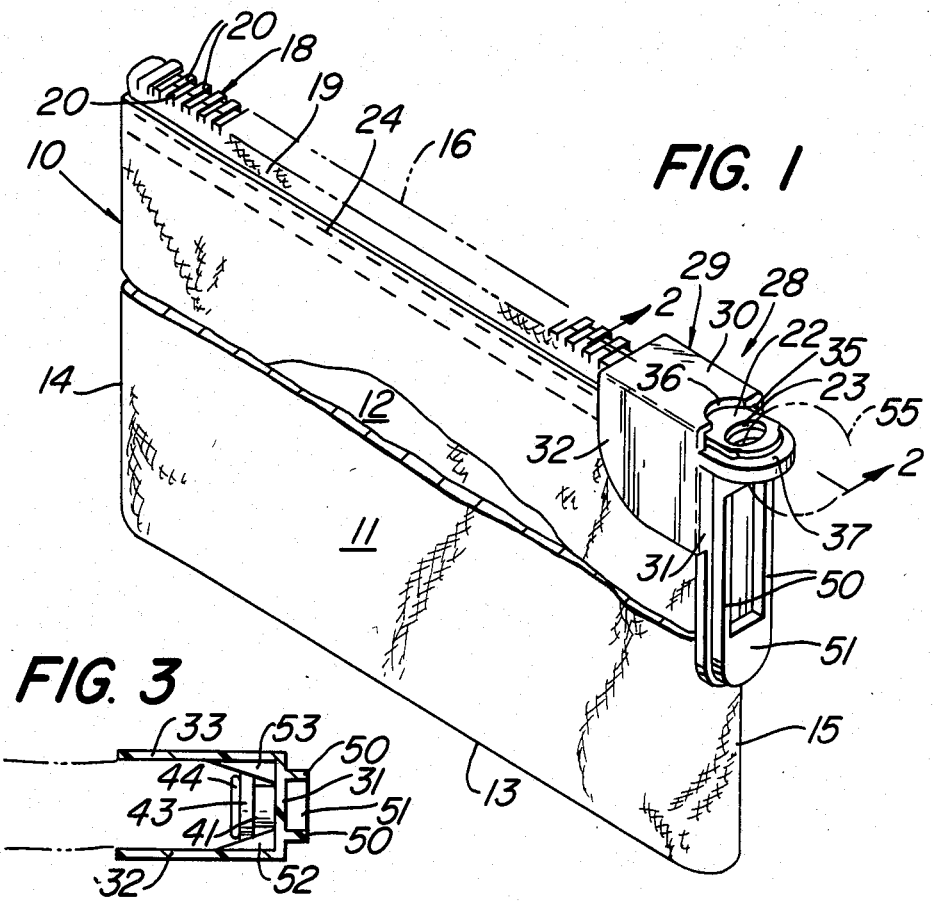
FIG. 1 is a top perspective view showing a bag having associated with a hood type seal of the present invention illustrated in a closed condition.
Figure 3:
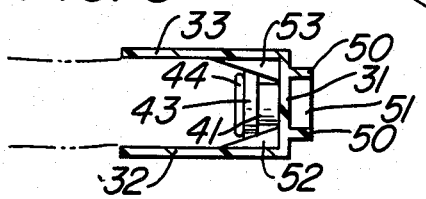
FIG. 3 is a partial sectional view taken generally along the line 3—3 of FIG. 2.

Referring now more particularly to the drawings, and specifically to FIG. 1 thereof, a bag is there generally designated 10, which may include a pair of facing walls 11 and 12, say of flexible sheet material or fabric. The walls 11 and 12 may be generally congruent, and of rectangular or other suitable outline configuration, being secured together along three sides or edges, as along a lower edge 13, and opposite end edges 14 and 15. The upper edge 16 of the bag is defined by a slide fastener 18 secured to upper edges of the facing walls 11 and 12 and extending between the end edges 14 and 15.

Figure 2:
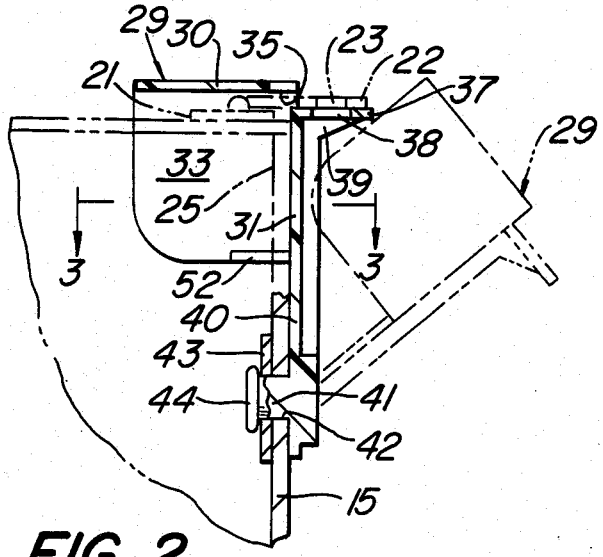
Figure 2 is a partial sectional elevational view taken generally along the line 2—2 of FIG. 1, and showing the seal in phantom in an unsealing position of movement.
Figure 4:
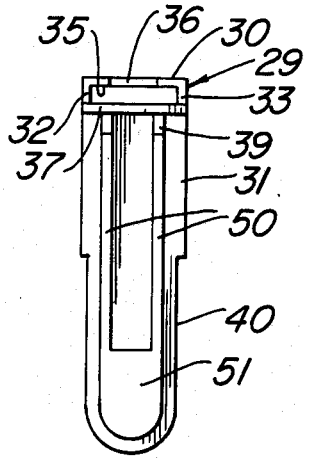
FIG. 4 is a side elevational view showing the hood type seal as taken from the right in FIG. 2.

The slide fastener 18 may include a pair of slide fastener runners 19 respectively secured, as by stiches 24, along the upper edges of bag wall 11 and 12. In conventional manner the slide runners 19 may include releasably interengageable teeth 20, and, a slider 21, see FIG. 2, is shiftable in conventional manner along the runners 19. Carried by the slider 21 is a slider pull or tab 22, swingably connected to the slider and having adjacent to its free end a through hole or aperture 23

It may be seen that the adjacent side edges of the bag 10 meet at generally 90° angles or corners. For example, the bag end edge 15 and upper bag edge 16 meet to define a bag corner 25, best seen in FIG. 2.

A seal assembly is generally designated 28, and includes a hood 29 shown in FIG. 1 as conformably covering the corner 25 of bag 10.

The hood 29 may be integrally fabricated of suitable material, such as plastic and formed by molding, or otherwise as desired.

The hood 29 includes a pair of edge walls 30 and 31 extending respectively along upper bag edge 16 and end bag edge 15. More specifically, the hood edge walls 30 and 31 are disposed in 90° dihedral angular relation with respect to each other, as best seen in FIGS. 1 and 2. Extending between the hood edge walls 30 and 31, on opposite sides of the bag 10, are respective hood side walls 32 and 33. Thus, the hood edge walls 30 and 31, and side walls 32 and 33 combine to define a generally 90° internal corner for conformably receiving the external corner 25 of the bag 10.

The hood edge wall 31 is formed with a through opening or passageway 35 contiguous to the hood edge wall 30. The through opening 35 may be laterally coextensive with the interior dimension between hood side walls 32 and 33; and, a semicircular cut-out or notch 36 may be formed in the hood edge wall 30, opening therethrough and into the passageway 35, for purposes appearing presently.

An external tab, projection or shoulder 37 may be provided on the hood edge wall 31, outstanding normal thereto, and having one surface flush to the end of edge wall 31 bounding the passageway or opening 35. The tab 37 is provided with a through aperture 38, see FIG. 2, for a purpose appearing presently. The tab 37 may be reinforced by a pair of braces or gussets 39, say of generally triangular configuration as illustrated, or otherwise as desired. The braces 39 each extend between the underside of tab 37, on opposite sides of the hole 38, and the adjacent portion of hood end wall 31.

A longitudinally extending arm 40 on the hood edge wall 31 extends beyond the hood side walls 32 and 33 along the bag edge 15 away from the bag edge 16. The extension or arm 40 is provided at its distal end with a projection, pin or rivet 41 extending through a hole 42 in the edge 15 of bag 10. This is best seen in FIG. 2. Interiorly of the bag 10, surrounding the pin 41, may be a ring or washer 43 retained on the pin by an enlargement or head 44 on the inner end of the pin.

The side edge 31 of hood 29 may be externally reinforced, as by a pair of longitudinally extending ribs 50; and, the distal or lower end of the arm 40 may be reinforced by a land or boss 51 extending between the ribs 50. Advantageously, the ribs 50 may define coplanar extensions of the braces 39, respectively, and the boss or land 51 may be a thickening of the arm or extension 40 and an extension of the ribs 50. The boss or land 51 is proximate to and in alignment with the pin 41, to reinforce the latter with respect to the arm 40.

In addition, a pair of braces or gussets 52 and 53 may extend respectively between the lower edges of hood side walls 32 and 33 and the adjacent inner portions of edge wall 31. These braces or gussets 52 and 53 effectively reinforce the connection between edge wall 31 and side walls 32 and 33 to resist forces from within the bag 10, and also forces manipulating the hood 29.

Manipulation of the hood 29 is shown in FIG. 2, the phantom position illustrating the hood being swung edgewise of the bag out of its covering relation with respect to the bag corner 25, which swinging movement is enabled by flexure of the material of bag edge 15. The rivet 41 may prevent rotation of the arm 40 about the rivet; or, the rivet may permit arm rotation and the hood may be swung about the pivotal axis of the rivet onto either side of the bag 10, as desired.

In the closed condition shown in FIG. 1, the slider pull 22 passes outwardly through the hood opening 35 along and overlying the hood tab or shelf 37, with the tab opening 38 in registry with the pull opening 23. This facilitates the extension of a shackle, shown diagrammatically at 55, through the registering openings 22 and 38. The sealing shackle may be that of a padlock, seal tie or other as desired. In this sealed condition it will be apparent that the slider 21 is retained in closed position with respect to the runners 19, so that tampering and pilferage is effectively prevented. The finger notch or cut-out 36 facilitates finger pulling of the tab 22 through the hood opening 35 along and into registry with the tab 37. Upon removal of the shackle 55 from the holes 23 and 38, the slider pull 22 may be manually inserted into the hood 29 through the opening 35, freeing the hood for uncovering movement to the phantom position shown in FIG. 2. In this position, the slider pull 22 is fully manually accessible for opening the slide fastener 18.

As the hood edge wall 31 and its extension arm 40 are solid, they combine to define a closed wall, so that flexible sheet material of bag 10 may not be manipulated to pass through such closed wall to avoid the security of the seal.

Although the present invention has been described in some detail by way of illustration and example for purposes of clarity of understanding, it is understood that certain changes and modifications may be made within the spirit of the invention.

What is claimed is:

1. The combination with a bag having a pair of side edges meeting at a corner, a pair of releasably interlocking slide runners along one of said bag edges terminating at said corner, a slider moveable along said runners toward said corner for interlocking the runners and away from said corner to release the runners, and an apertured slider pull extending from said slider; of a seal comprising a hood conformably covering said corner, hood mounting means mounting said hood to said bag for movement into and out of said covering relation with said corner, said hood having an opening for passing said slider pull when said slider is in position towards said corner, and an apertured tab projecting from said hood adjacent to said opening and positioned to lie along said slider pull passed through said opening with the tab and pull apertures in registry for receiving a sealing shackle.

2. The combination according to claim 1, said hood comprising a pair of edge walls in dihedral angular relation over said corner with one edge wall covering said one bag edge at said corner and the other edge wall covering the other bag edge at said corner, and a pair of generally parallel side walls extending across the interior angle of said edge walls and overlying opposite sides of said bag.

3. The combination according to claim 2, said opening being located in said other edge wall adjacent to the vertex of said angle, and said tab extending from said other edge wall adjacent to said opening along said pull passed through said opening.

4. The combination according to claim 2, said hood mounting means comprising an arm extending from said other edge wall away from the vertex of said angle, and rivet means connecting the extending end of said arm to said bag.

5. The combination according to claim 4, said one edge wall having a cut-out adjacent to said vertex and communicating with said opening, for improved finger access to said opening.

6. The combination according to claim 4, said other edge wall and arm being integral to prevent movement therethrough of the bag corner for releasing the slide runners.

7. The combination according to claim 6, in combination with reinforcing extending between said other edge wall and side walls to resist separation thereof.

* * * * *